US010087567B2

(12) United States Patent
Leisl, III et al.

(10) Patent No.: US 10,087,567 B2
(45) Date of Patent: Oct. 2, 2018

(54) CONTROL PANEL FOR A WASHING MACHINE APPLIANCE

(71) Applicant: Haier US Appliance Solutions, Inc., Wilmington, DE (US)

(72) Inventors: Donald James Leisl, III, Louisville, KY (US); Craig Robert Vitan, Louisville, KY (US); Christopher Gene Vowels, Cox's Creek, KY (US); Sripad Kulkarni, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 50 days.

(21) Appl. No.: 15/202,637

(22) Filed: Jul. 6, 2016

(65) Prior Publication Data

US 2018/0010287 A1 Jan. 11, 2018

(51) Int. Cl.

| | |
|---|---|
| ***D06F 39/00*** | (2006.01) |
| ***D06F 23/04*** | (2006.01) |
| ***D06F 39/14*** | (2006.01) |
| ***D06F 33/02*** | (2006.01) |

(52) U.S. Cl.

CPC ..... *D06F 39/005* (2013.01); *D06F 23/04* (2013.01); *D06F 33/02* (2013.01); *D06F 39/14* (2013.01)

(58) Field of Classification Search

None

See application file for complete search history.

(56) References Cited

U.S. PATENT DOCUMENTS 5,253,493 A * 10/1993 Ohashi ..... D06F 39/14 220/812
5,870,787 A * 2/1999 Choi ..... D06F 39/14 134/113
2009/0066205 A1* 3/2009 Park ..... D06F 39/005 312/228
2009/0293923 A1* 12/2009 Buogo ..... D06F 39/024 134/58 D
2014/0190083 A1* 7/2014 Lepie ..... E05B 43/00 49/30
2015/0107308 A1* 4/2015 Sharp ..... D06F 13/02 68/133
2017/0204553 A1* 7/2017 Leibman ..... D06F 39/028

FOREIGN PATENT DOCUMENTS

JP 4953758 B2 6/2012
WO WO2015139489 A1 9/2015

* cited by examiner

*Primary Examiner* — Jason Y Ko
*Assistant Examiner* — Cristi J Tate-Sims
(74) *Attorney, Agent, or Firm* — Dority & Manning, P.A.

(57) ABSTRACT

A washing machine appliance and control panel is provided herein. The washing machine appliance may include a cabinet defining an opening, a basket, a door, a secondary control panel, and a controller. The basket may be mounted within the cabinet and define a wash chamber beneath the opening to receive one or more clothing articles to be washed. The door may be pivotally attached to the cabinet and selectively movable between an open position and a closed position. The secondary control panel may be disposed on the cabinet within a closed footprint of the door. The secondary control panel may be covered beneath the door in the closed position. The controller may be operatively connected to the secondary control panel. The controller may be configured to receive an input signal from the secondary control panel, and initiate an operative step in response to the input signal.

18 Claims, 6 Drawing Sheets

CONTROL PANEL FOR A WASHING MACHINE APPLIANCE

FIELD OF THE INVENTION

The present subject matter relates generally to control panels for appliances, such as washing machine appliances.

BACKGROUND OF THE INVENTION

Washing machine appliances generally include a cabinet including a tub for containing wash fluid, e.g., water, and detergent, bleach, and/or other fluid additives. A basket is rotatably mounted within the tub and defines a wash chamber for receipt of articles for washing. A lid or door is attached to the cabinet to move between and open and closed position and allow a user to selectively access the wash chamber of the basket. During operation of such washing machine appliances, the lid is moved to a closed position and a wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

A user input or control panel is provided to allow a user to select one or more operation for the washing machine appliance. Often, the control panel is provided at a rear portion of the cabinet. Advantageously, this positioning may prevent inadvertent input selections and avoid restricting user access to the wash chamber. However, if the lid is in the open position, the control panel may be blocked or covered. For instance, in a vertical axis washing machine, the lid may pivot toward the control panel to reach the open position and/or permit access to the wash chamber. In order to initiate an operation, a user will, thus, need to move the lid toward the closed position. In other words, access to the wash chamber is sacrificed for access to the control panel.

Although this tradeoff may be acceptable in some instances, other instances may arise wherein equal access to the control panel and the wash chamber is desired. For example, certain articles of clothing may require an initial soak or hand wash. Other articles may require inspection before an automated wash cycle is otherwise complete. Addressing such articles using existing systems may require a cumbersome back-and-forth as the user alternates between accessing the control panel and the wash chamber.

Accordingly, a washing machine appliance with a feature for allowing a user access to certain functions of the appliance without restricting access into the wash chamber would be advantageous. Furthermore, it may also be advantageous to provide a washing machine appliance with a feature for allowing a user access to certain functions of the appliance while a door of the appliance is in an open position, without increasing the risk of inadvertently selecting a function while the door is in a closed position.

BRIEF DESCRIPTION OF THE INVENTION

Aspects and advantages of the invention will be set forth in part in the following description, or may be obvious from the description, or may be learned through practice of the invention.

In one aspect of the present disclosure, a washing machine appliance is provided. The washing machine appliance may include a cabinet defining an opening, a basket, a door, a secondary control panel, and a controller. The basket may be mounted within the cabinet. The basket may define a wash chamber beneath the opening to receive one or more clothing articles to be washed. The door may be pivotally attached to the cabinet. The door may be selectively movable between an open position and a closed position. In the closed position, the door may define a closed footprint covering the opening of the cabinet. The secondary control panel may be disposed on the cabinet within the closed footprint of the door. The secondary control panel may be covered beneath the door in the closed position. The controller may be operatively connected to the secondary control panel. The controller may be configured to receive an input signal from the secondary control panel, and initiate an operative step in response to the input signal.

In another aspect of the present disclosure, a washing machine appliance is provided and defines a plurality of mutually-orthogonal directions. The mutually-orthogonal directions may include a lateral direction, a transverse direction, and a vertical direction. The washing machine appliance may include a cabinet defining an opening, a basket, a primary control panel, a door, a secondary control panel, and a controller. The basket may be mounted within the cabinet. The basket may define a wash chamber beneath the opening to receive one or more clothing articles to be washed. The primary control panel may be disposed at a rear portion of the cabinet. The door may be pivotally attached to the cabinet. The door may be selectively movable between an open position and a closed position. In the closed position, the door may have a closed footprint restricting access to the opening. The secondary control panel may be disposed on the cabinet. The secondary control panel may include at least one selectively-engageable user input switch that is spaced apart from the primary control panel along the transverse direction. The controller may be operatively connected to the primary control panel and the secondary control panel. The controller may be configured to receive an input signal from at least one of the primary control panel or the secondary control panel, and initiate an operative step in response to the input signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
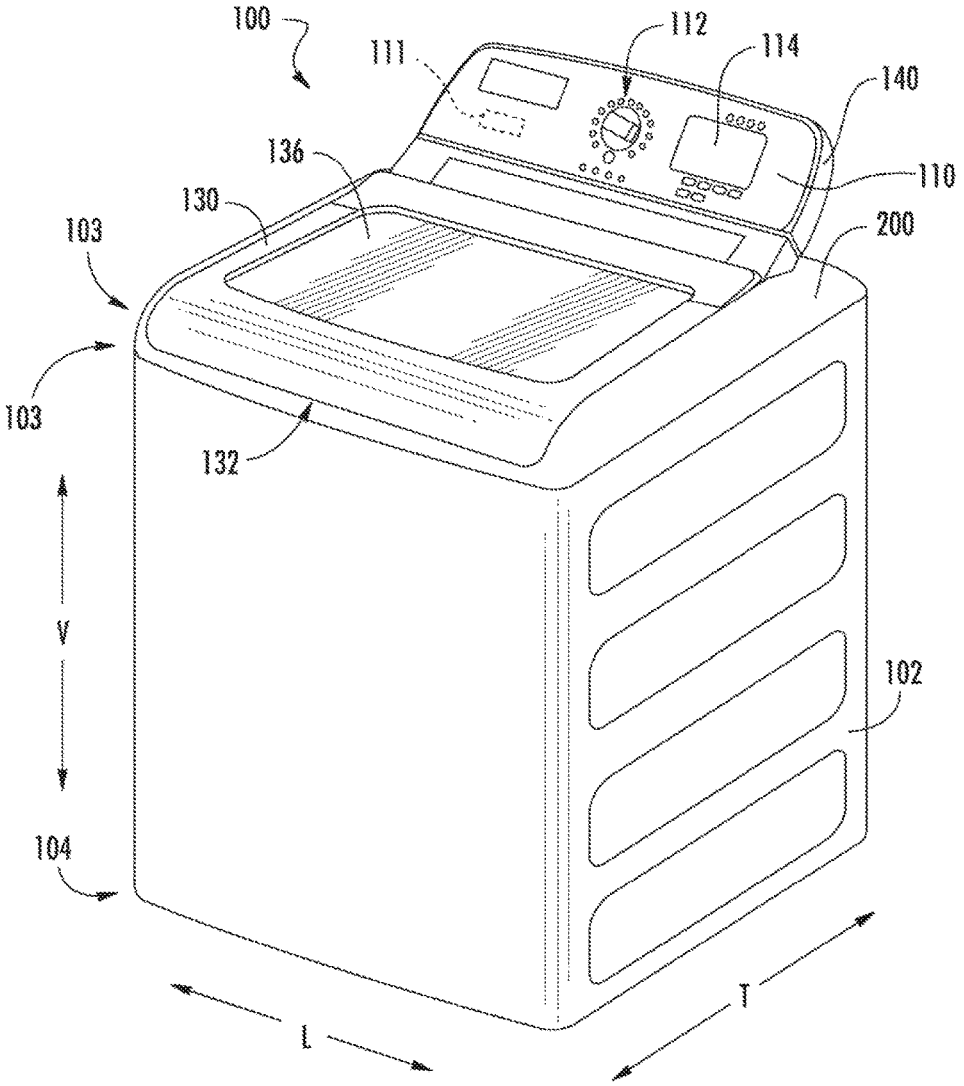
FIG. 1 provides a perspective view of a washing machine appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present subject matter provides a washing machine appliance that includes a cabinet that houses or holds a control panel at a front portion of the cabinet. The control panel at the front portion may allow a user to initiate or control certain predetermined functions of the washing machine. Moreover, the control panel may be positioned such that it is substantially covered by the door in the closed position. Another or primary control panel may also be provided a rear portion of the cabinet, for instance, on a backsplash.

Figure 2:
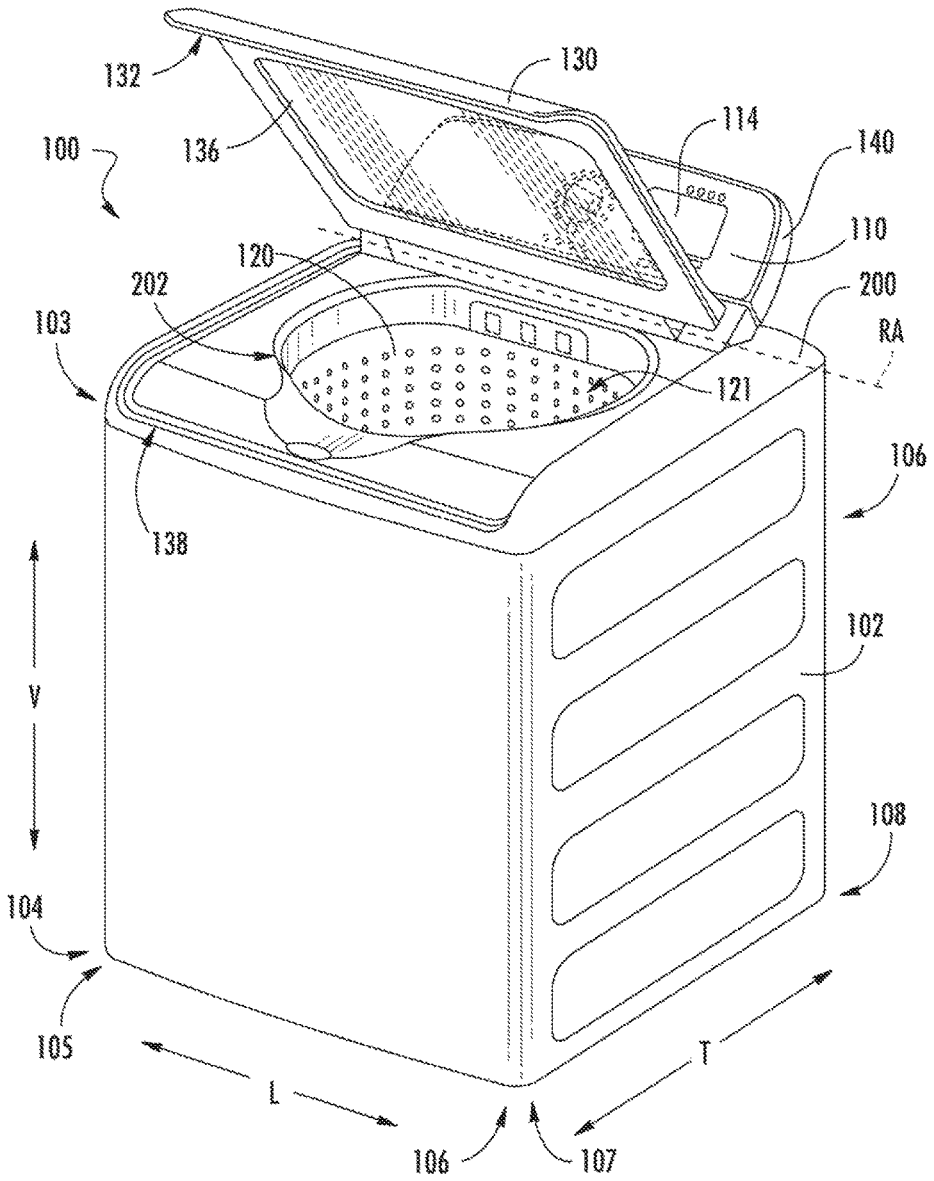
FIG. 2 provides a perspective view of the exemplary washing machine appliance of FIG. 1 with the door shown in an open position.
Figure 3:
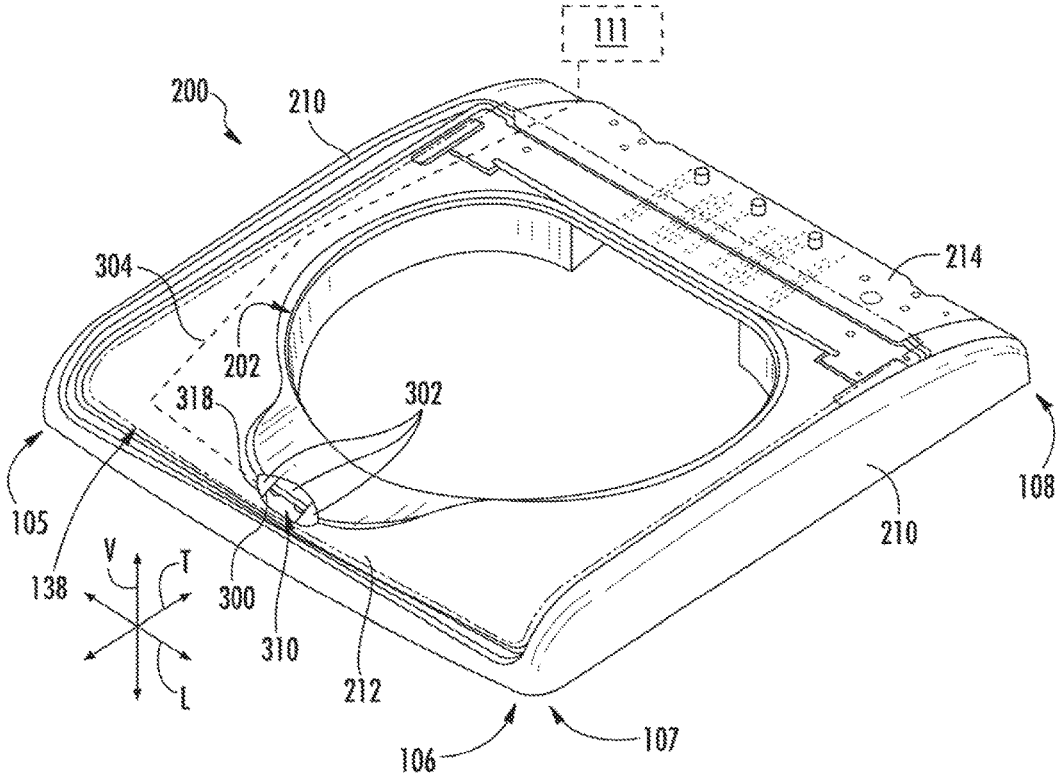
FIG. 3 provides a perspective view of a portion of the cabinet of the exemplary washing machine appliance of FIG. 1.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well.

As may be seen in FIGS. 1 and 2, washing machine appliance 100 defines a vertical direction V, a lateral direction L, and a transverse direction T. The vertical direction V, lateral direction L, and transverse direction T are mutually perpendicular and form an orthogonal direction system. Washing machine appliance 100 has a cabinet 102 that extends between a top portion 103 and a bottom portion 104 along the vertical direction V. Cabinet 102 also extends between a first side portion 105 and a second side portion 106, e.g., along the lateral direction L, and a front portion 107 and a rear portion 108, e.g., along the transverse direction T.

A wash basket 120 is rotatably mounted within cabinet 102, e.g., within a wash tub (not shown) disposed within cabinet 102. A motor (not shown) is in mechanical communication with wash basket 120 in order to selectively rotate wash basket 120, e.g., during an agitation or a rinse cycle of washing machine appliance 100. Wash basket 120 defines a wash chamber 121 that is configured for receipt of articles for washing. An agitator or impeller (not shown) extends from wash basket 120 into wash chamber 121. The impeller assists agitation of articles disposed within wash chamber 121 during operation of washing machine appliance 100.

Cabinet 102 of washing machine appliance 100 has a top panel 200 positioned at or adjacent top portion 103 of cabinet 102. Top panel 200 defines an opening 202 that permits user access to wash chamber 121 of wash basket 120. Door 130 is rotatably mounted to top panel 200 and defines a footprint 138 thereon. However, in alternative embodiments, door 130 may be mounted to another portion of cabinet 102 and/or any outer suitable support.

Door 130 selectively rotates about a pivot axis RA defined on cabinet 102. Specifically, door 130 rotates between the closed position shown in FIG. 1 and the open position shown in FIG. 2. In the closed position, door 130 inhibits access to wash chamber 121 and covers the closed footprint 138. Conversely, in the open position, a user can access wash chamber 121 as door 130 is positioned above and away from footprint 138. In optional embodiments, a window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

A backsplash 140 is disposed at rear portion 108 of cabinet 102 and houses a controller or processing device 111. A primary control panel 110 is disposed on backsplash 140. As shown, primary control panel 110 includes a plurality of input selectors 112, e.g., buttons, knobs, electrical touch panels, etc. Moreover, primary control panel 110 extends from top panel 200 on backsplash 140 at top portion 103 of cabinet 102. A display 114 of primary control panel 110 indicates selected features, a countdown timer, and/or other items of interest to appliance users. As shown, primary control panel 110 is separated from pivot axis RA, e.g., in the transverse direction T. In turn, primary control panel 110 is at least partially covered by door 130 when door 130 is in the open position.

Separate from backsplash 140, a secondary control panel 300 is disposed on cabinet 102 at or near front portion 107 of cabinet 102. As shown, in some embodiments, secondary control panel 300 is disposed opposite backsplash 140 on top panel 200 within closed footprint 138 of the door 130. As a result, secondary control panel 300 is covered beneath door 130 in the closed position. Advantageously, secondary control panel 300 is accessible for user input when door 130 is in the open position, but inaccessible when door 130 is in the closed position. Inadvertent selections on secondary control panel 300 may, thus, be prevented when door 120 is rotated to the closed position. As will be described below, secondary control panel 300 includes a plurality of input selectors 302 for initiating or selecting an appliance operation or feature. Together, primary control panel 110 and secondary control panel 300 form a user interface input for operator selection of machine cycles and features. Each of primary control panel 110 and secondary control panel 300 may be used or engaged separately, or may be engaged in conjunction with each other.

Generally, operation of washing machine appliance 100 is controlled by controller 111, which is operatively coupled to primary control panel 110 and/or secondary control panel 300 for user manipulation to select various washing machine cycles, features, or operative steps. In response to user manipulation of primary control panel 110 and/or secondary control panel 200, controller 111 operates the various components of washing machine appliance 100 to execute selected machine cycles, features, or operative steps.

In an illustrative embodiment, door 120 is moved into open position, allowing laundry items to be loaded into wash chamber 121 through opening 202, and washing operation is initiated through operator manipulation of input selectors 112 and/or 302. Wash basket 120 or the wash tub is filled with water and/or detergent to form a wash fluid. One or more valves (not shown) can be controlled by washing machine appliance 100 to provide for filling wash basket 120 to the appropriate level for the amount of articles being washed. Door 130 can be moved into the closed position. Once wash basket 120 is properly filled with fluid, the contents of wash chamber 121 are agitated (e.g., with the impeller) for cleansing of laundry items in wash basket 120.

After the agitation phase of the wash cycle is completed, wash basket 120 is drained. Laundry articles can then be rinsed by again adding fluid to wash basket 120, depending on the particulars of the cleaning cycle selected by a user, the impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through opening 202.

Turning to FIGS. 3 through 6, top panel 200 is formed to support all or some of the user interface. In exemplary embodiments, such as those illustrated, top panel 200 includes a pair of side rails or frame members 210, a front rail or frame member 212 and a back rail or frame member 214. Each one of side frame members 210 is positioned at or adjacent a respective one of first and second side portions 105, 106 of cabinet 102 (FIG. 2). Thus, side frame members 210 are spaced apart from each other along the lateral direction L, and are also positioned at opposite sides of top panel 200 along the lateral direction L. Front frame member 212 is positioned at or adjacent to front portion 107 of cabinet 102, and back frame member 214 is positioned at or adjacent to rear portion 108 of cabinet 102. Thus, front frame member 212 and back frame member 214 are spaced apart from each other along the transverse direction T, and are also positioned at opposite sides of top panel 200 along the transverse direction T. Side frame members 210, front frame member 212, and back frame member 214 assist with defining opening 202, e.g., at a center of top panel 200, as well as the closed footprint 138 on which door 130 rests in the closed position. Optionally, side frame members 210, front frame member 212, and back frame member 214 are integrally formed with one another, e.g., such that side frame members 210, front frame member 212, and back frame member 214 are constructed of or with a single continuous piece of material, such as a plastic and/or metal.

Top panel 200 supports secondary control panel 300 at a location beneath door 130 (see FIG. 2). Specifically, secondary control panel 300 is supported within the closed footprint 138 of door 130. In turn, an upward facing portion of secondary control panel 300 is covered by door 130 in the closed position, but is engageable by a user when door 130 is in the open position. For instance, in the illustrated embodiments, cover supports secondary control panel 300 at front frame member 212 within the closed footprint 138. An upper portion 318 of secondary control panel 300, e.g., input selectors 302, is disposed on or above front frame member 212, e.g., in the vertical direction V. However, when door 130 is rotated into the closed position, input selectors 302 are generally inaccessible, covered by door 302, which extends across input selectors 302 in the lateral direction L and the transverse direction T at a position above the input selectors 302 in the vertical direction V.

As shown, secondary control panel 300 includes a plurality of input selectors 302 configured as selectively-engageable user input switches. Each input selector 302, i.e., selectively-engageable user input switch, is disposed on top panel 200 forward from opening 202 for convenient selection of certain appliance functions. Although controller 111 may be positioned apart from secondary control panel 300, e.g., at backsplash 140, an operable connection is provided to allow direct communication from secondary control panel 300 to controller 111. In exemplary embodiments, a direct wired connection is established between secondary control panel 300 and controller 111. A shielded wiring path 304 extending through cabinet 102, e.g., within top panel 200, prevents interference that might otherwise be caused by cabinet 102 or other portions of washing machine 100 (See FIG. 2). Optionally, a suitable electromagnetic shielding sleeve (not shown) (e.g., composed of braided copper, aluminum, conductive polymer strands, etc.) may be provided at the shielded wiring path 304.

When door 130 is disposed in the open position, user input selectors 302 are generally accessible to receive a user's input. Optionally, once the door 130 is moved out of the closed position, user input selectors 302 may receive input from and be engaged by user. Once engaged, e.g., by user, input selector 302 may signal controller 111 to select an appliance function or operative step. In turn, controller 111 may receive an input signal from secondary control panel 300, and initiate an operative step in response to the input signal. The operative step(s) may be automatically executed, e.g., by valves, impeller, and/or motor. For instance, the appliance may automatically direct a washing fluid within the wash chamber 121, e.g., dispense hot water, dispense cold water, or draining wash fluid within wash chamber 121 (See FIG. 2). Additional or alternative exemplary operative steps include executing preprogrammed cleaning cycles, such as a spin-free delicate wash cycle.

User input selector 302 may be configured as a suitable engagement member. For instance, in some embodiments, input selector 302 may include a mechanically-actuated button or plunger. In additional or alternative embodiments, input selector 302 may include an electronic interface, such as a capacitive or resistive touch sensor. In further additional or alternative embodiments, user input selector 302 may include an in-mold printed electronic circuit, such as a conductive ink circuit printed within a flexible polymer material, e.g., polycarbonate, polyvinyl chloride (PVC), polyethylene terephthalate (PET), etc.

Figure 4:
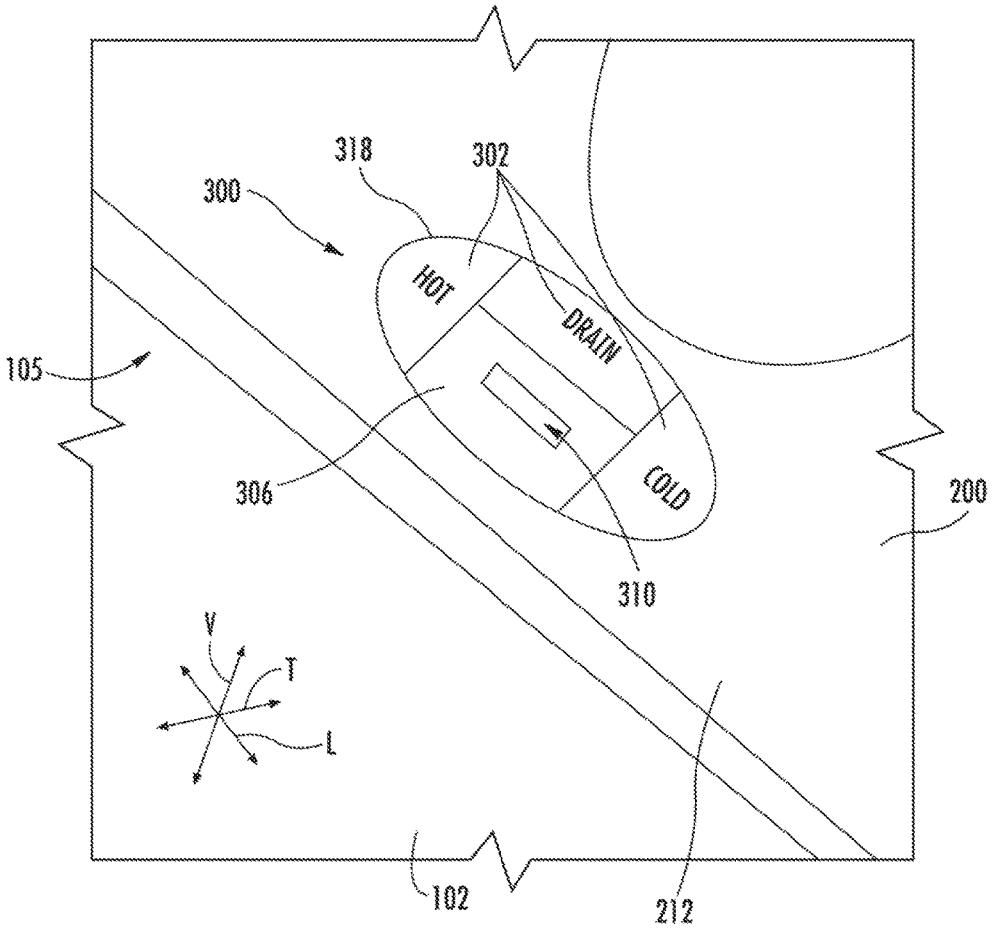
FIG. 4 provides a perspective view of a secondary control panel on a washing machine appliance in according to an exemplary embodiment of the present disclosure.
Figure 5:
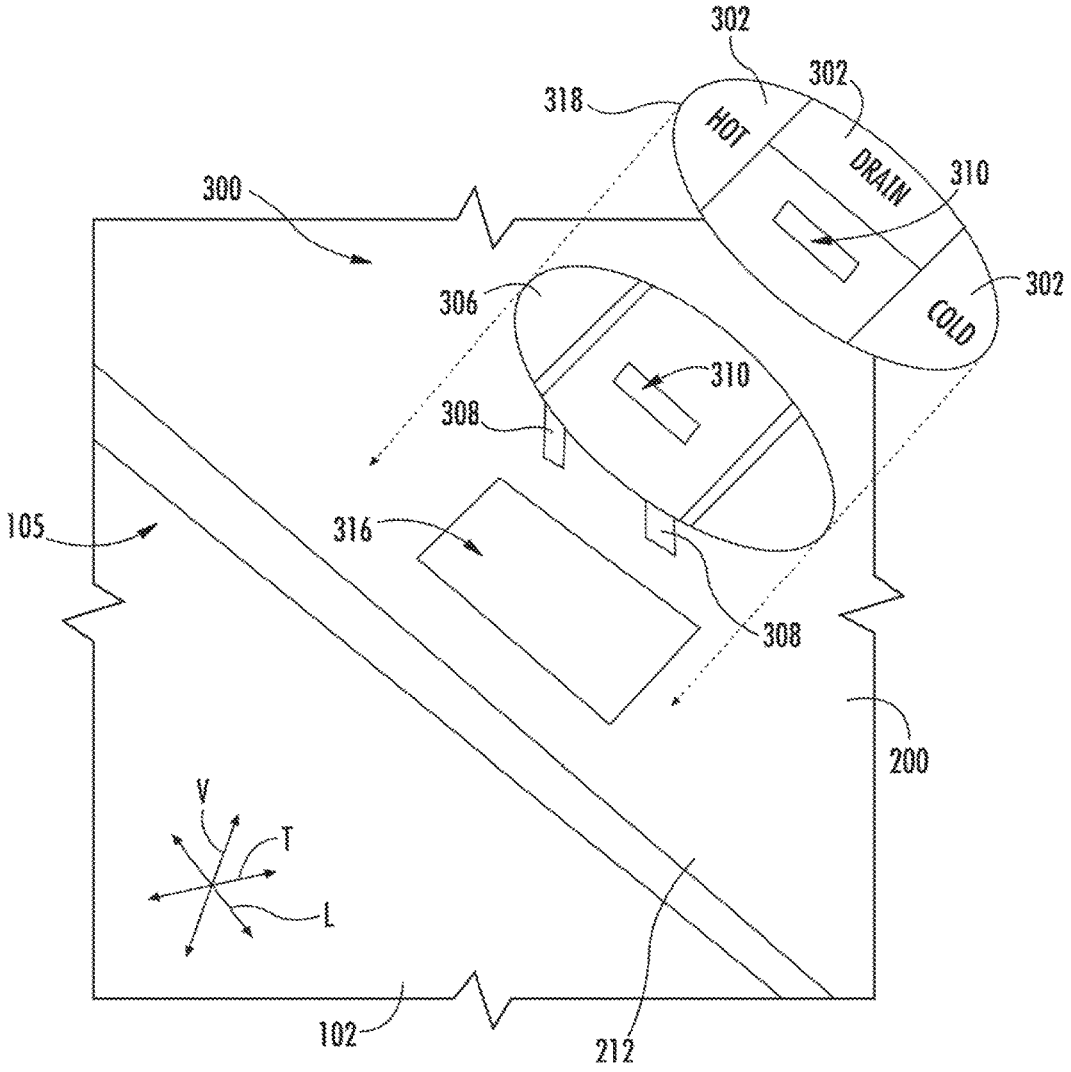
FIG. 5 provides an exploded perspective view of the exemplary secondary control panel of FIG. 4.
Figure 6:
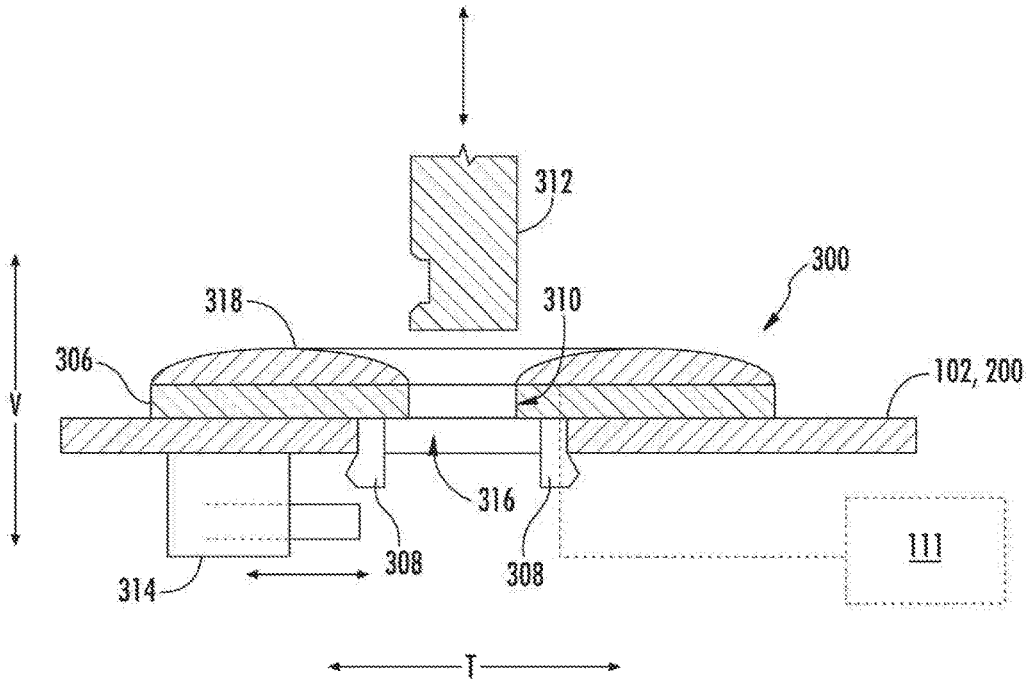
FIG. 6 provides a cross-sectional side view of the exemplary secondary control panel of FIG. 4, including a portion of a door received therein.

As illustrated in FIGS. 4 through 6, some embodiments of secondary control panel 300 are configured as a discrete separable member that is attached to cabinet 102. In some such embodiments, secondary control panel 300 includes a lock bracket 306 supporting input selectors 302. Lock bracket 306 selectively attaches to and engages with top panel 200. One or more tabs 308, e.g., resilient prongs, extend from a bottom portion of lock bracket 306 and engage top panel 200. Multiples user input selectors 302 may be positioned about the lock bracket 306, radially-spaced therefrom, e.g., such that input selectors 302 form a generally circular or semi-circular pattern around a portion of lock bracket 306.

In some embodiments, lock bracket 306 is formed as a preconfigured or molded body, such as an injection molded body. The injection molded body is generally configured to support each user input selector 302 such that multiple input selectors 302 may be positioned thereon. In exemplary embodiments, lock bracket 306 is integrally formed such that the body and/or another portion of secondary control panel 300 form a single continuous piece of material, such as a plastic and/or metal. Furthermore, in certain embodiments, user input selector 302 and lock bracket 306 are integrally-formed as an in-mold printed electronic circuit body.

Optionally, lock bracket 306 and upper portion 318 define a key hole 310 to engage door, e.g., by receiving an interlocking tooth 312 extending from door 130 (See FIG. 2). Key hole 310 may be defined, for example, such that user input selectors 302 are distributed about or around key hole 310. Advantageously, the user input selectors 302 may be easily detected and engaged when door 130 is in the open position. During certain operations of an appliance, such as a high-speed spin cycle, door 130 (See FIGS. 1 and 2) may be locked in the closed position. For instance, in the closed position, interlocking tooth 312 extends through key hole 310. If a lock command is initiated, e.g., by controller 111, a door actuator 314 may be selectively extended to engage interlocking tooth 312, holding interlocking tooth 312 through key hole 310. In alternative embodiments, however, another suitable lock assembly may be provided to selectively hold a door in the closed position, covering secondary control panel 300.

As shown in FIGS. 5 and 6, in some embodiments, cabinet 102, e.g., top panel 200, defines a bracket aperture 316 at which lock bracket 306 can be selectively positioned. Bracket aperture 316, generally defines a perimeter suitable to receive a portion of secondary control panel 300. In turn, secondary control panel 300 includes one or more tabs 308, e.g., resilient prongs, that extend from a bottom portion of lock bracket 306. Top panel 200 defines bracket aperture 316 such that that tabs 308 may be fitted therethrough. For instance, in optional embodiments, tabs 308 are configured as resilient prongs sized to extend beyond a perimeter of bracket aperture 316. When attaching secondary control panel 300 to top panel 200, tabs 308 deflect radially inward, i.e., within the perimeter of the bracket aperture 316. Once secondary control panel 300 is properly positioned, e.g., relative to bracket aperture 316, tabs 308 deflect radially outward, beyond the perimeter of bracket aperture 316 and beneath cabinet 102. Thus, tabs 308 may hold secondary control panel 300 to cabinet 102. In additional or alternative embodiments, one or more suitable attachment members, e.g., screw, adhesive, interlocking bracket, etc., may be further provided to attach secondary control panel 300 to cabinet 102.

As shown, bracket aperture 316 is generally aligned with key hole 310. As a result, a continuous void is defined from an upper portion 318 of secondary control panel 300 to an internal surface 220 of cabinet 102. When door 130 is in the closed position, interlocking tooth 312 extends simultaneously through key hole 310 and bracket aperture 316.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine defining a plurality of mutually-orthogonal directions, the mutually-orthogonal directions including a lateral direction, a transverse direction, and a vertical direction, the washing machine comprising:

a cabinet defining an opening;

a basket mounted within the cabinet, the basket defining a wash chamber beneath the opening to receive one or more clothing articles to be washed;

a primary control panel disposed at a rear portion of the cabinet;

a door pivotally attached to the cabinet, the door being selectively movable between an open position and a closed position, the door having a closed footprint restricting access to the opening in the closed position;

a secondary control panel disposed on the cabinet, the secondary control panel including at least one selectively-engageable user input switch spaced apart from the primary control panel along the transverse direction; and a controller operatively connected to the primary control panel and the secondary control panel, the controller being configured to receive an input signal from at least one of the primary control panel or the secondary control panel, and initiate an operative step in response to the input signal, wherein the secondary control panel is disposed on the cabinet within the footprint of the door such that the secondary control panel is covered by the door in the closed position and is spaced apart from the door in the open position.

2. The washing machine of claim 1, wherein the door defines a pivot axis on the cabinet, the pivot axis being separated from the primary control panel in the transverse direction, and wherein the door at least partially covers the primary control panel when the door is in the open position.

3. The washing machine of claim 1, wherein the secondary control panel includes a lock bracket to selectively engage the door.

4. The washing machine of claim 3, wherein the cabinet further defines a bracket aperture, and wherein the secondary control panel is disposed at the bracket aperture.

5. The washing machine of claim 3, wherein the selectively-engageable user input switch includes a plurality of user input switches positioned about the lock bracket.

6. The washing machine of claim 3, wherein the lock bracket includes an injection molded body.

7. The washing appliance of claim 1, wherein the operative step includes directing a flow of a washing fluid within the wash chamber.

8. The washing appliance of claim 1, further comprising a backsplash disposed at the rear portion of the cabinet, wherein the backsplash houses at least a portion of the controller, and wherein the primary control panel is disposed on the backsplash.

9. The washing appliance of claim 8, wherein the secondary control panel is disposed at a front portion of the cabinet, opposite the backsplash.

10. The washing appliance of claim 9, further comprising a shielded wire path extending within the cabinet between the secondary control panel and the controller.

11. A washing machine defining a plurality of mutually-orthogonal directions, the mutually-orthogonal directions including a lateral direction, a transverse direction, and a vertical direction, the washing machine comprising:

a cabinet defining an opening;

a basket mounted within the cabinet, the basket defining a wash chamber beneath the opening to receive one or more clothing articles to be washed;

a primary control panel disposed at a rear portion of the cabinet;

a door pivotally attached to the cabinet, the door being selectively movable between an open position and a closed position, the door having a closed footprint restricting access to the opening in the closed position;

a secondary control panel disposed on the cabinet, the secondary control panel including at least one selectively-engageable user input switch spaced apart from the primary control panel along the transverse direction; and a controller operatively connected to the primary control panel and the secondary control panel, the controller being configured to receive an input signal from at least one of the primary control panel or the secondary control panel, and initiate an operative step in response to the input signal, wherein the secondary control panel includes a lock bracket to selectively engage the door, and wherein the cabinet further defines a bracket aperture, and wherein the secondary control panel is disposed at the bracket aperture.

12. The washing machine of claim 11, wherein the door defines a pivot axis on the cabinet, the pivot axis being separated from the primary control panel in the transverse direction, and wherein the door at least partially covers the primary control panel when the door is in the open position.

13. The washing machine of claim 11, wherein the selectively-engageable user input switch includes a plurality of user input switches positioned about the lock bracket.

14. The washing machine of claim 11, wherein the lock bracket includes an injection molded body.

15. The washing appliance of claim 11, wherein the operative step includes directing a flow of a washing fluid within the wash chamber.

16. The washing appliance of claim 11, further comprising a backsplash disposed at the rear portion of the cabinet, wherein the backsplash houses at least a portion of the controller, and wherein the primary control panel is disposed on the backsplash.

17. The washing appliance of claim 16, wherein the secondary control panel is disposed at a front portion of the cabinet, opposite the backsplash.

18. The washing appliance of claim 17, further comprising a shielded wire path extending within the cabinet between the secondary control panel and the controller.

* * * * *